US011596246B2

(12) United States Patent
Jennings

(10) Patent No.: US 11,596,246 B2
(45) Date of Patent: Mar. 7, 2023

(54) COMFORT POSITIONING PILLOW

(71) Applicant: East Road Enterprises LLC, Potsdam, NY (US)

(72) Inventor: Andrew Jennings, Lowville, NY (US)

(73) Assignee: East Road Enterprises LLC, Potsdam, NY (US)

( * ) Notice: Subject to any disclaimer, the term of this patent is extended or adjusted under 35 U.S.C. 154(b) by 0 days.

(21) Appl. No.: 16/252,122

(22) Filed: Jan. 18, 2019

(65) Prior Publication Data

US 2020/0229622 A1 Jul. 23, 2020

(51) Int. Cl.

| | |
|---|---|
| ***A47G 9/10*** | (2006.01) |
| ***A47C 20/00*** | (2006.01) |
| ***A61G 7/075*** | (2006.01) |
| ***A47C 20/02*** | (2006.01) |

(52) U.S. Cl.

CPC ..... *A47G 9/1009* (2013.01); *A47C 20/021* (2013.01); *A47C 20/026* (2013.01); *A61G 7/0755* (2013.01)

(58) Field of Classification Search

CPC ..... A47G 9/1009; A47G 9/00; A47G 9/10; A47G 2009/001; A47G 2009/002; A47G 2009/1018; A47G 2009/1081; A47G 2009/109; A47C 20/021; A47C 20/026; A47C 20/025; A61G 7/0755

See application file for complete search history.

(56) References Cited

U.S. PATENT DOCUMENTS 5,940,913 A * 8/1999 Horowitz ..... A47G 9/10 5/640
7,150,057 B1 * 12/2006 Santiago ..... A47C 20/021 5/648

OTHER PUBLICATIONS

Flanigan, Ryan M., et al.; "The Influence of Foot Position on Stretching of the Plantar Fascia"; Foot & Ankle International, vol. 28 No. 7, Jul. 2007, pp. 815-822.

(Continued)

*Primary Examiner* — Eric J Kurilla

(74) *Attorney, Agent, or Firm* — Woods Oviatt Gilman LLP; Dennis B. Danella, Esq.

(57) ABSTRACT

A comfort positioning pillow for use with a user's foot is provided. The pillow includes a first side surface; a second side surface; a flat front surface disposed between the first and second side surfaces; a flat back surface disposed between the first and second side surfaces, wherein the flat back surface is positioned at an angle relative to the flat front surface; a top surface disposed between the first and second side surfaces, wherein the top surface is convex-shaped; and a bottom surface disposed between the first and second side surfaces, and disposed between the flat front surface and the flat back surface. One or more methods of using the pillow are also provided.

18 Claims, 5 Drawing Sheets

(56) References Cited

OTHER PUBLICATIONS

Engkananuwat, Phoomchai, et al.; "Effectiveness of the Simultaneous Stretching of the Achilles Tendon and Plantar Fascia in Individuals With Plantar Fasciitis"; American Orthopaedic Foot & Ankle Society; Foot & Ankle International 2018, vol. 39(1), pp. 75-82.

Sharma, Neena K., et al.; "Splinting and stretching for plantar fasciitis pain"; Lower Extremity Review Magazine; Oct. 2010; https://lermagazine.com/article/splinting-and-stretching-for-plantar-fasciitis-pain, last accessed Jul. 15, 2021.

Lee, Winson C. C., et al.; "Effectiveness of adjustable dorsiflexion night splint in combination with accommodative foot orthosis on plantar fasciitis"; J. Rehabil Res Dev./JRRD vol. 49, No. 10, 2012; pp. 1557-1564.

* cited by examiner

COMFORT POSITIONING PILLOW

FIELD OF THE INVENTION

The present invention relates to a comfort positioning pillow; in particular, a comfort positioning pillow for a human foot or other human appendage; and more particularly to a comfort positioning pillow to provide support and positioning for the human foot to alleviate foot and heel pain, such as that caused by plantar fasciitis.

BACKGROUND OF THE INVENTION

Millions of people suffer from foot and heel pain every year. A large percentage of these individuals suffer from a condition known as plantar fasciitis which is caused by irritation and/or inflammation of the plantar fascia, the connective tissue that runs along the bottom of the foot and connects the heel to the toes. While the cause of plantar fasciitis is not known, certain activities such as long periods of standing or long distance running may overuse the plantar fascia leading to small tears in the tissue. These small tears may become inflamed and result in the sufferer feeling stabbing pain in the heel and along the bottom of the foot.

Treatment of plantar fasciitis typically employs conservative approaches, such as resting the injured area and stretching and strengthening of the plantar fascia and Achilles tendon. Pain may be eased using typical over-the-counter pain relievers, such as ibuprofen, naproxen or aspirin. During the day, sufferers may also use orthotics placed in the shoe to help in more evenly distributing pressure to the foot and hold the foot and arch in a more neutral position. However, these shoes/orthotics are not designed to be worn during sleeping hours. While sleeping, sufferers are frequently recommended to wear a night splint to promote stretching of the plantar fascia by holding the foot in a flexed position, thereby lengthening the plantar fascia and Achilles tendon during sleep. However, many wearers complain of discomfort and interruption in sleeping when using these splints.

Accordingly, there is a need for an alternative treatment approach to night splints when sleeping for alleviating plantar fasciitis. The present invention addresses this need, as well as other needs, by providing a foot support device which promotes stretching of the plantar fascia while the user lies down, while also providing for a more comfortable and restful sleep.

BRIEF SUMMARY OF THE INVENTION

As will be described in more detail below, one aspect of the present invention provides a comfort positioning pillow for use with at least one foot. In one aspect, the pillow may comprise a first side surface, a second side surface, a flat front surface disposed between the first and second side surfaces, and a flat back surface disposed between the first and second side surfaces. The flat back surface is positioned at an angle, such as, for example, between seventy degrees and approximately one-hundred degrees, relative to the flat front surface. In another example, the angle may be ninety degrees. The pillow may further include a convex-shaped top surface disposed between the first and second side surfaces, and a bottom surface disposed between the first and second side surfaces, and between the flat front surface and the flat back surface. The pillow may further include an inner core and an outer casing, wherein the inner core is disposed within the outer casing. The inner core may be formed of polyurethane foam, and the outer casing may be formed of stretch terry cloth. One or more methods of using the pillow are also provided.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
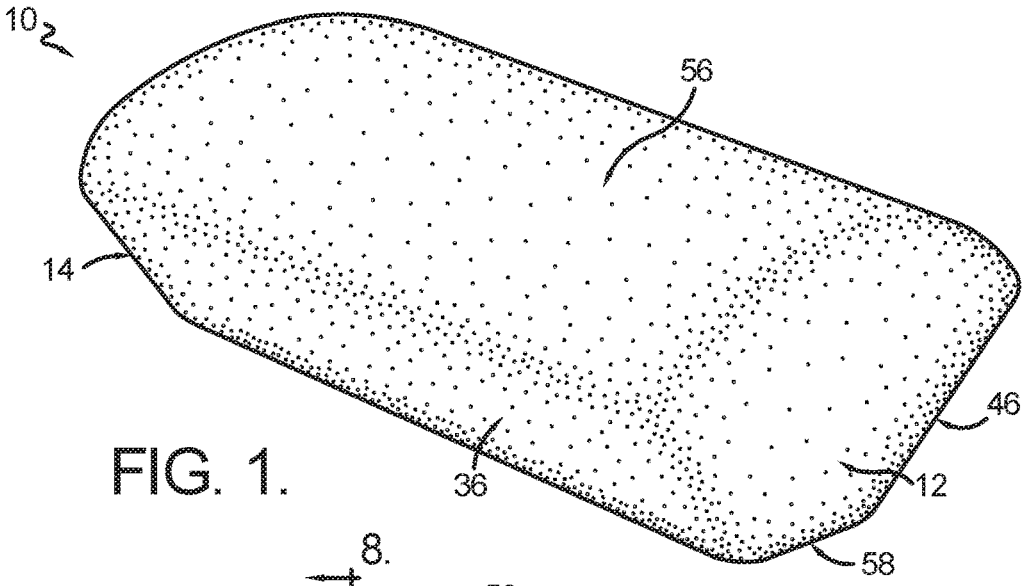
FIG. 1 is a front right perspective view of a comfort positioning pillow in accordance with one aspect of the present invention.
Figure 2:
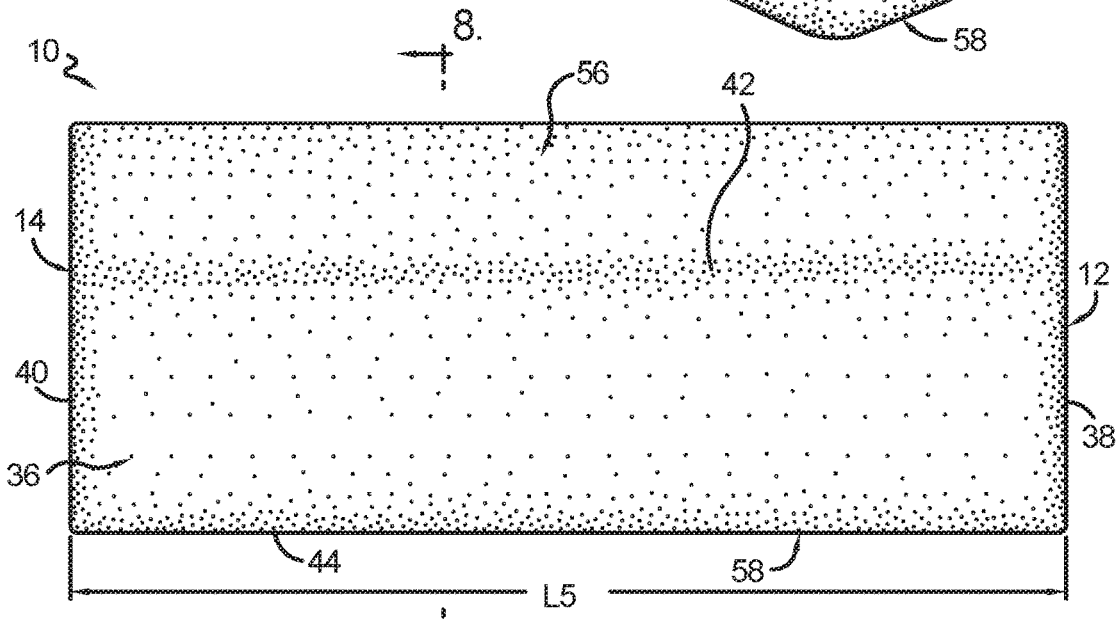
FIG. 2 is a front view of the comfort support pillow shown in FIG. 1.

Referring to the drawings in detail, and specifically to FIGS. 1-8, reference numeral 10 generally designates a comfort positioning device, such as a pillow, in accordance with an aspect of the present invention. In general, pillow 10 may be used in association with a human appendage, such as, but not limited to at least one foot, to assist with relief that may be needed when a user has a condition known as plantar fasciitis. For instance, pillow 10 may be used to promote stretching of the plantar fascia while the user sits or lies down, as will be described in more detail below. In other aspects, pillow 10 may also be used in association with at least one ankle, leg, arm or hand to provide support for these appendages in various contexts.

Figure 3:
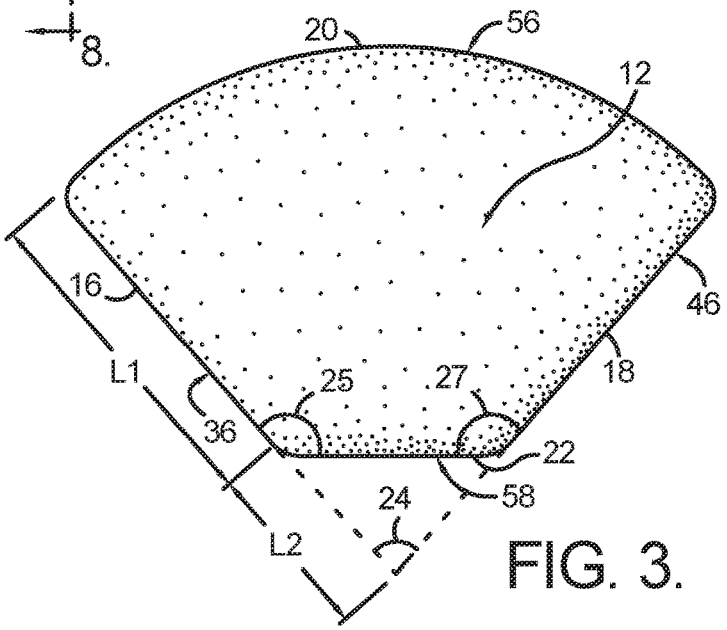
FIG. 3 is a right side view of the comfort support pillow shown in FIG. 1.
Figure 4:
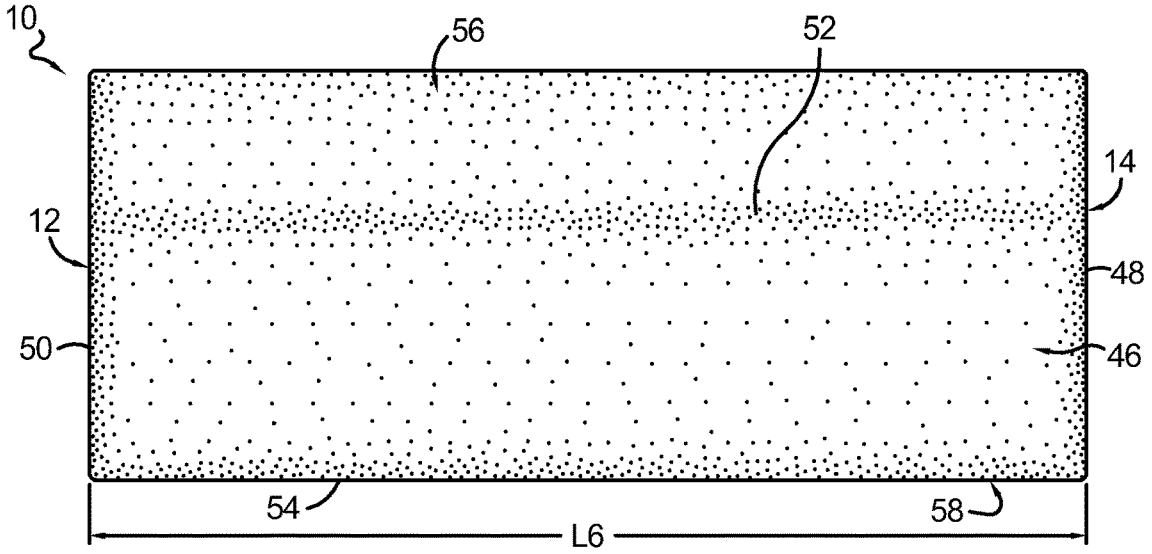
FIG. 4 is a back view of the comfort support pillow shown in FIG. 1.
Figure 5:
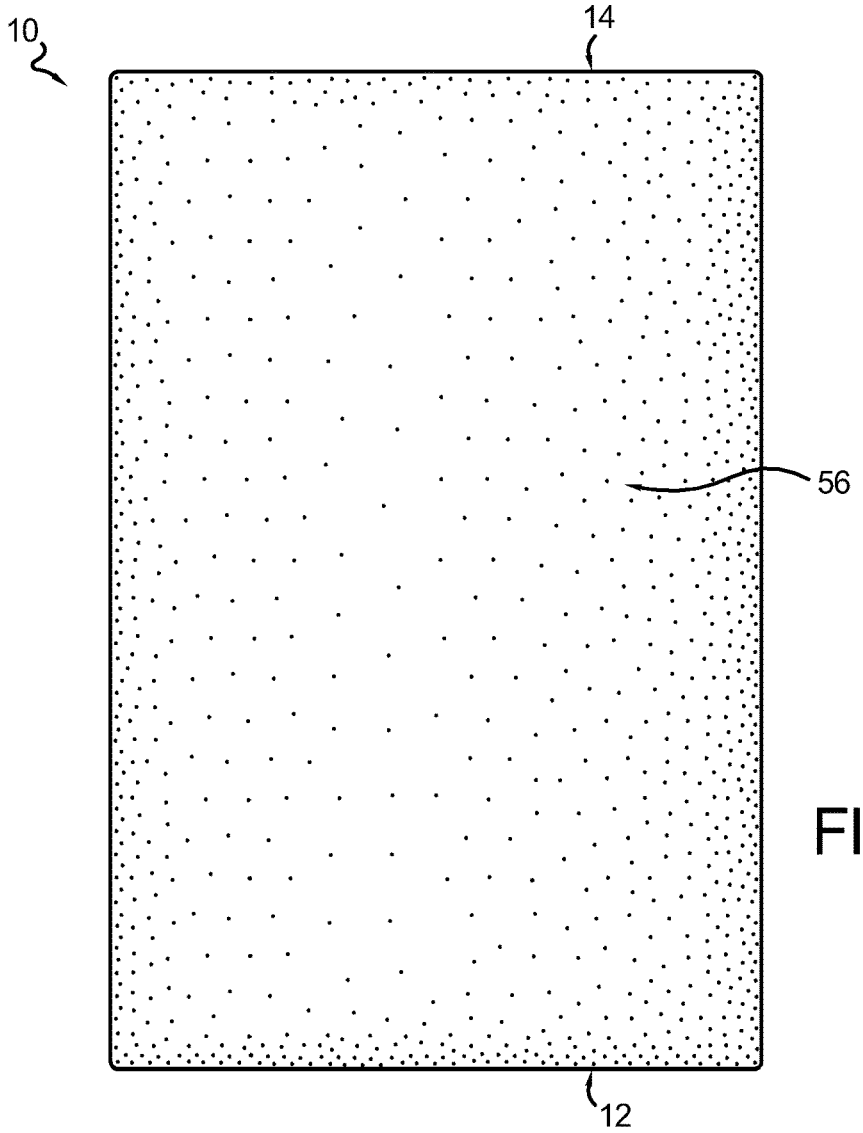
FIG. 5 is a top view of the comfort support pillow shown in FIG. 1.

Pillow 10 includes first and second opposing side surfaces 12, 14. As best seen in FIG. 3, first side surface 12 may be flat and include a first edge 16, a second edge 18, a top edge 20, and a bottom edge 22. Top edge 20 is convex-shaped when viewing the outside of pillow 10, and may be an arc including a radius having a length (L1+L2). Bottom edge 22 is positioned between first and second edges 16, 18, and top edge 20 is positioned between first and second edges 16, 18.

As can be seen in FIG. 3, the length of top edge 20 is greater than the length of bottom edge 22. Further, first and second edges 16, 18 are disposed at an angle 24 relative to one another. For example, angle 24 may be between approximately seventy degrees and approximately one-hundred degrees, and in another example angle 24 may be ninety degrees. Further, in an example where angle 24 is ninety degrees, bottom edge 22 may be disposed at an angle 25 of one-hundred and thirty five degrees relative to first edge 16, and be disposed at an angle 27 of one-hundred and thirty five degrees relative to second side surface edge 18. It should be understood that first and second edges 16, 18 may have the same length (L1), and bottom edge 22 extends from a bottom portion of first edge 16 to a bottom portion of second edge 18. For illustrative purposes only, and not to limit the scope of the invention in any way, the length (L1) of first edge 16 may be 5½ inches and length (L2) may be 2⅝ inches.

Figure 6:
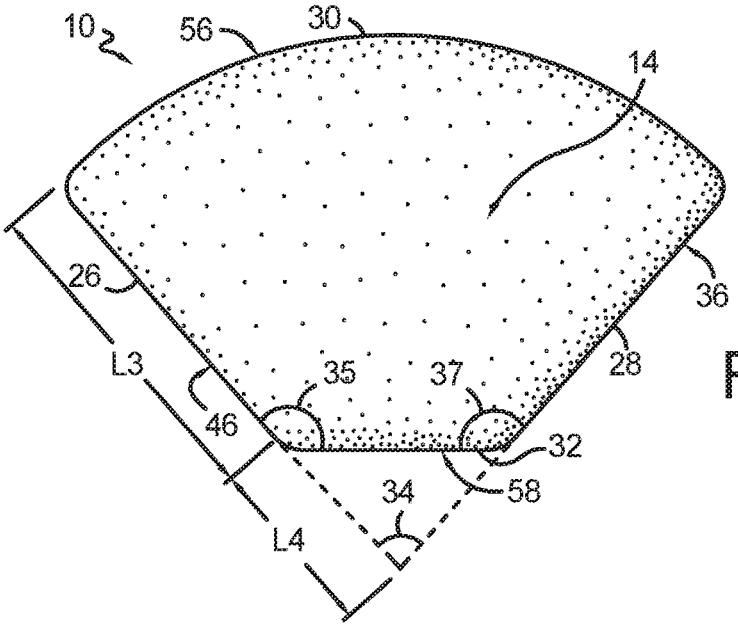
FIG. 6 is a left side view of the comfort support pillow shown in FIG. 1.
Figure 7:
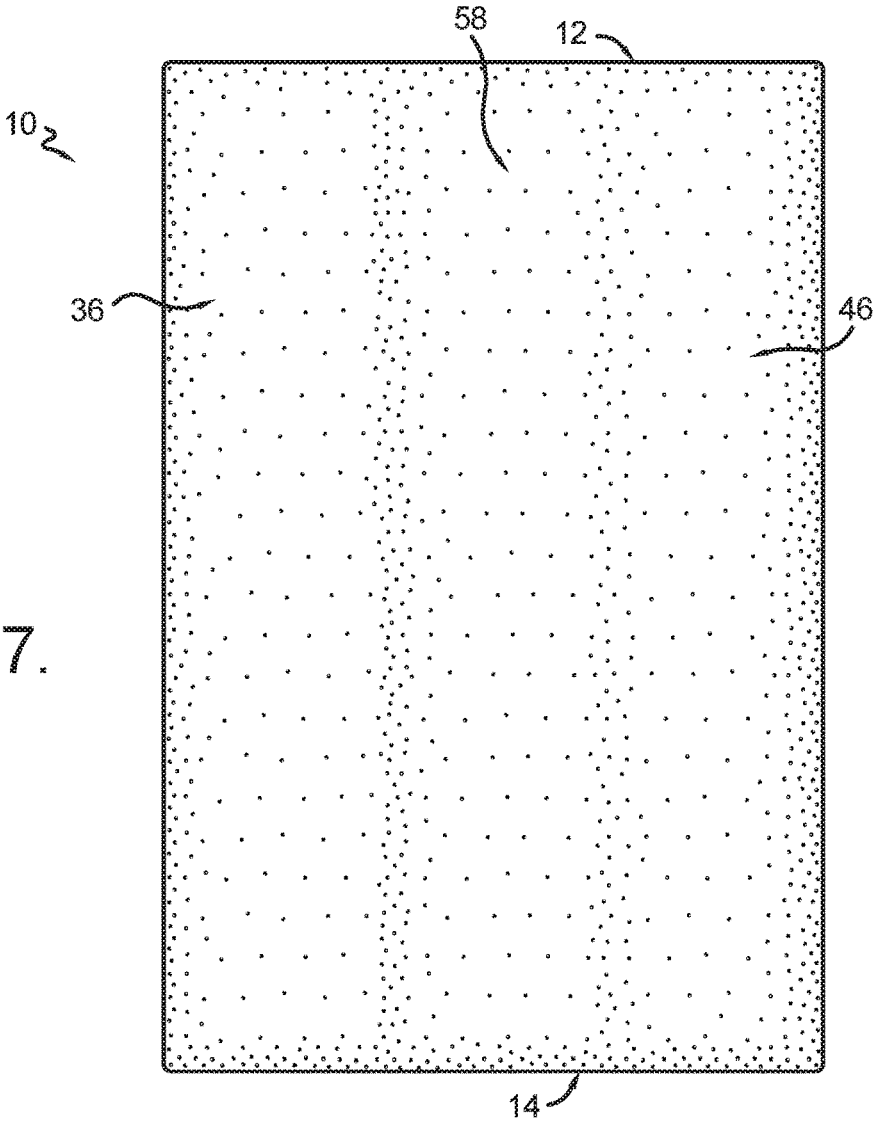
FIG. 7 is a bottom view of the comfort support pillow shown in FIG. 1.

As best seen in FIG. 6, second side surface 14 may be flat and include a first edge 26, a second edge 28, a top edge 30, and a bottom edge 32. Top edge 30 is convex-shaped when viewing the outside of pillow 10, and may be an arc including a radius having a length (L3+L4). Bottom edge 32 is positioned between first and second edges 26, 28, and top edge 30 is positioned between first and second edges 26, 28. As can be seen in FIG. 3, the length of top edge 30 is greater than the length of bottom edge 32. Further, first and second edges 26, 28 are disposed at an angle 34 relative to one another. For example, angle 34 may be between approximately seventy degrees and approximately one-hundred degrees, and in another example acute angle 34 may be ninety degrees. Further, in an example where angle 34 is ninety degrees, bottom edge 32 may be disposed at an angle 35 of one-hundred and thirty five degrees relative to first edge 26, and be disposed at an angle 37 of one-hundred and thirty five degrees relative to second edge 28. It should be understood that first and second edges 26, 28 may have the same length (L3), and bottom edge 32 extends from a bottom portion of first edge 26 to a bottom portion of second edge 28. For illustrative purposes only, and not to limit the scope of the invention in any way, the length (L3) of first edge 26 may be 5½ inches and length (L4) may be 2⅝ inches. Further, length (L3) may be equal to length (L1), and length (L4) may be equal to length (L2). Further, first and second side surfaces 12, 14 may have the same shape and/or proportions.

As best seen in FIGS. 1, 2, 3, 6 and 7, pillow 10 further includes a front surface 36. With specific reference to FIG. 2, front surface 36 may be flat and include a first end edge 38, a second edge 40, a top edge 42, and a bottom edge 44. Front surface 36 extends between first and second side surfaces 12, 14. The first edge 38 intersects with first edge 16 of first side surface 12, and second edge 40 intersects with second edge 28 of second side surface 14. For illustrative purposes only, and not to limit the scope of the invention in any way, the length (L5) of front surface 36 may be 16¼ inches.

As best seen in FIGS. 1, 3, 4, 6 and 7, pillow 10 further includes a back surface 46. With specific reference to FIG. 3, back surface 46 may be flat and include a first edge 48, a second edge 50, a top edge 52, and a bottom edge 54. Back surface 46 extends between first and second side surfaces 12, 14. The first edge 48 intersects with first edge 26 of second side surface 14, and second edge 50 intersects with second edge 18 of first side surface 12. As best seen in FIGS. 3 and 6, back surface 46 lies on a plane that is disposed at angle 24 and/or 34 relative to the plane that front surface 36 lies on. For example, angle 24 and/or 34 may be between approximately seventy degrees and approximately one-hundred degrees, and in another example angle 24, 34 may be ninety degrees. For illustrative purposes only, and not to limit the scope of the invention in any way, the length (L6) of back surface 46 may be 16¼ inches.

As best seen in FIGS. 1-6, pillow 10 further includes a top surface 56. Top surface 56 extends between the respective top edges 20, 30 of first and second side surfaces 12, 14, and extends between the respective top edges 42, 52 of front and back surfaces 36, 46. As can be seen in FIGS. 1, 3 and 6, top surface 56 is convex-shaped, and may be an arc including a radius having a length (L1+L2 and/or L3+L4).

As best seen in FIGS. 1, 2, 3, 4, 6 and 7, pillow 10 further includes a bottom surface 58. Bottom surface 58 may be flat and extend between the respective bottom end edges 22, 32 of first and second side surfaces 12, 14. Bottom surface 58 also extends between the respective bottom edges 44, 54 of front and back surfaces 36, 46.

Figure 8:
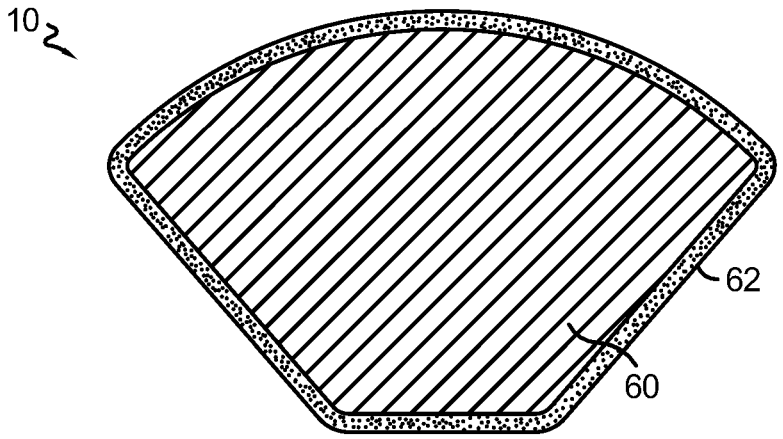
FIG. 8 is a cross-sectional view taken along line 8-8 in FIG. 2.

As can be seen in FIG. 8, pillow 10 may include an inner core 60 and an outer casing 62. Inner core 60 may be formed of a polyurethane foam material to provide comfort to a user of pillow 10. Inner core 60 may be disposed within outer casing 62. Outer casing 62 may be formed of a stretch terry cloth and take the form of inner core 60 when used to enclose inner core 60.

Figure 9:
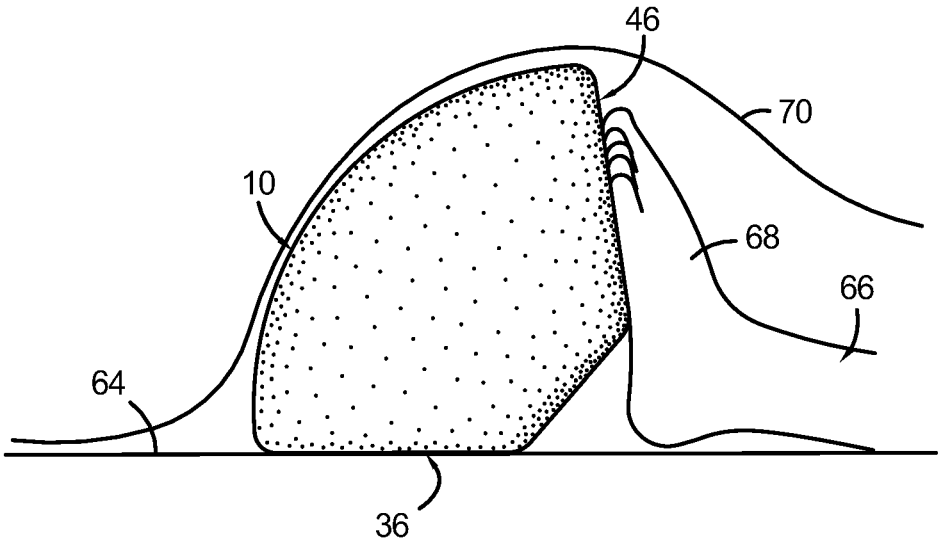
FIG. 9 is a side view of the comfort support apparatus shown in FIG. 1 showing one exemplary use.

Having described pillow 10 in detail, exemplary methods of using pillow 10 will now be provided. In one instance, a user may use pillow 10 to stretch his or her plantar fascia when in bed and under the bed covers. As best seen in FIG. 9, pillow 10 would be positioned on a support surface 64, such as a bed mattress, so that first front surface 36 is resting against support surface 64. A user 66 would then place the bottom of his foot 68 against back surface 46 to place the foot in a position to keep the foot 68 in a flexed position to stretch the plantar fascia while resting in bed. Further, a bed cover 70 could then be draped over top surface 56 of pillow 10 to prevent bed cover from coming into contact with the toes of the foot 68 and thereby force the toes toward the bed mattress 64.

Figure 10:
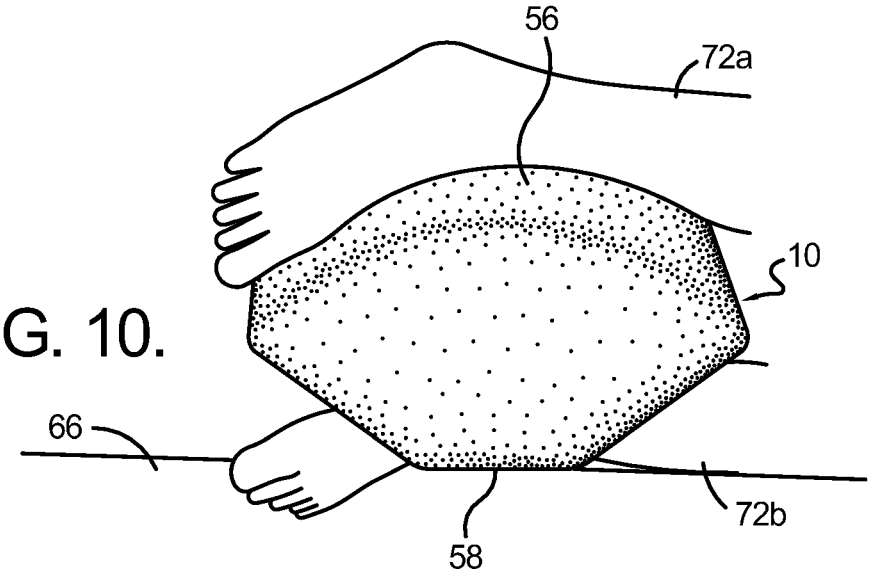
FIG. 10 is a side perspective view of the comfort support pillow shown in FIG. 1 showing another exemplary use.

In another exemplary method, as best seen in FIG. 10, pillow 10 may be positioned between the feet, ankles and/or legs of user 66 to keep spacing between the user's legs to provide for a more comfortable position. In particular, one of the legs 72*a* of user 66 may be disposed on top of the convex top surface 56 of pillow, and the other leg 72*b* of user 66 may be disposed between support surface 64 and bottom surface 58 of pillow.

Figure 11:
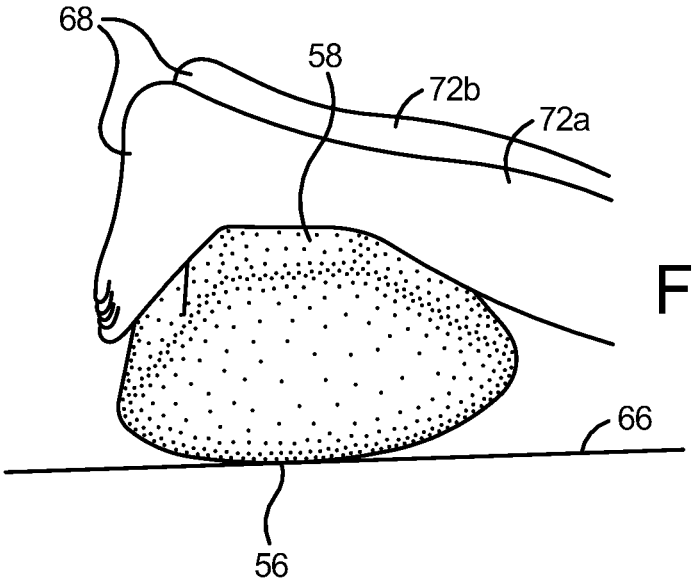
FIG. 11 is a side perspective view of the comfort support pillow shown in FIG. 1 showing yet another exemplary use.

In yet another exemplary method, as best seen in FIG. 11, convex top surface 56 may be disposed against support surface 64, and bottom surface 58 of pillow 10 may provide support for the legs 72*a*, 72*b* of user 66 when user 66 is lying on his or her stomach. Pillow 10 allows for one or more feet 68 to remain in a normal position while user 66 is lying on his or her stomach and eliminates the need for the toes to be disposed in a pointed position against support surface 66.

Figure 12:
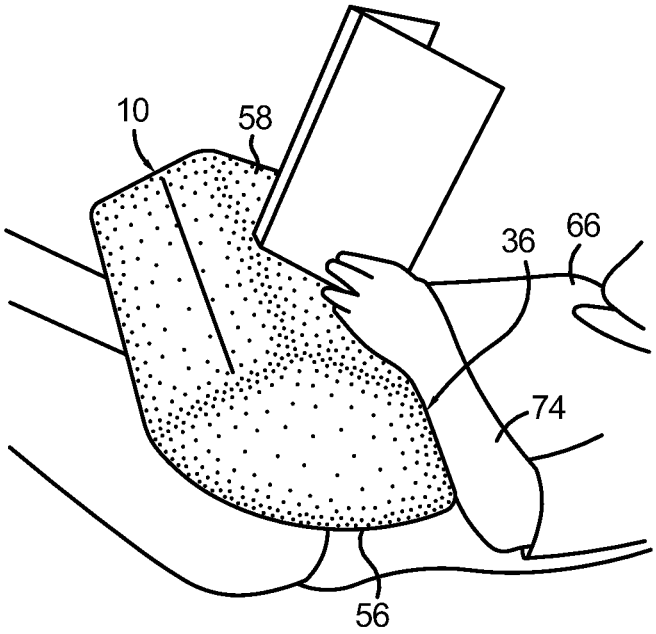
FIG. 12 is a side front perspective view of the comfort support pillow shown in FIG. 1 showing a further exemplary use.

In a further exemplary method, as best seen in FIG. 12, pillow 10 may be used in the lap of user 66 to provide support for a user's hands or arms. In particular, convex top surface 56 is disposed against the lap of user 66 and bottom surface 58 is used to provide the desired support. Further, the angled orientation of first side surface 12 provide a comfortable resting location for the arms 74 of user 66.

From the foregoing, it will be seen that this invention is one well adapted to attain all the ends and objects hereinabove set forth together with other advantages which are obvious and which are inherent to the device described herein. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. As used herein, the terms "having" and/or "including" and other terms of inclusion are terms indicative of inclusion rather than requirement. Further, it should be understood that the use of the terms "module" and "component" herein are interchangeable and shall have the same meaning.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed is:

1. A comfort positioning pillow for use with at least one appendage, the pillow comprising:

a first side surface including a first edge, a second edge, a top edge, and a bottom edge, wherein the top edge of the first side surface is convex-shaped;

a second side surface including a first edge, a second edge, a top edge, and a bottom edge, wherein the top edge of the second side surface is convex-shaped;

a front surface including a first edge, a second edge, a top edge, and a bottom edge, wherein the front surface extends between the first and second side surfaces, wherein the first edge of the front surface intersects with the first edge of the first side surface, and wherein the second edge of the front surface intersects with the second edge of the second side surface;

a back surface including a first edge, a second edge, a top edge, and a bottom edge, wherein the back surface extends between the first and second side surfaces, wherein the first edge of the back surface intersects with the first edge of the second side surface, wherein the second edge of the back surface intersects with the second edge of the first side surface;

a top surface extending between the respective top edges of the first and second side surfaces, and extending between the respective top edges of the front and back surfaces, wherein the top surface is convex-shaped; and a bottom surface extending between the respective bottom edges of the first and second side surfaces, and extending between the respective bottom edges of the front and back surfaces, wherein the back surface is disposed at an angle between ninety degrees and one hundred degrees relative to the front surface, whereby when the front surface of the pillow is positioned on a support surface, the back surface provides an upright surface against which the bottoms of a user's feet are supported when the user is lying supinely on the support surface, and whereby when the top surface of the pillow is positioned on a support surface, the front surface and the bottom surface each support the user's leg while the back surface provides a resting surface against which the tops of the user's feet are supported when the user is lying prone on the support surface.

2. A comfort positioning pillow in accordance with claim 1, wherein the pillow includes an inner core and an outer casing, wherein the inner core is disposed within the outer casing.

3. A comfort positioning pillow in accordance with claim 2, wherein the inner core is formed of polyurethane foam.

4. A comfort positioning pillow in accordance with claim 3, wherein the outer casing is formed of stretch terry cloth.

5. A comfort positioning pillow in accordance with claim 1, wherein the angle is ninety degrees.

6. A comfort positioning pillow in accordance with claim 1, wherein the first side surface and the second side surface are the same shape.

7. A comfort positioning pillow in accordance with claim 6, wherein the first side surface and the second side surface have the same dimensions.

8. A comfort positioning pillow in accordance with claim 1, wherein the front and back surfaces are both flat.

9. A comfort positioning pillow in accordance with claim 8, wherein the bottom surface is flat.

10. A comfort positioning pillow in accordance with claim 1, wherein the top edge of the first side surface is longer than the bottom edge of the first side surface.

11. A comfort positioning pillow in accordance with claim 10, wherein the top edge of the second side surface is longer than the bottom edge of the second side surface.

12. A comfort positioning pillow for use with an appendage, the pillow comprising:

a first side surface;

a second side surface;

a flat front surface disposed between a first edge of the first side surface and a first edge of the second side surface;

a flat back surface disposed between a second edge of the first side surface and a second edge of the second side surface, wherein the respective first edges and the respective second edges have the same length and wherein the flat back surface is positioned at an angle of ninety degrees relative to the flat front surface;

a top surface disposed between a top edge of the first side surface and a top edge of the second side surface, wherein the top surface is convex-shaped; and a bottom surface disposed between a bottom edge of the first side surface and a bottom edge of the second side surface, and disposed between the flat front surface and the flat back surface, wherein each top edge has a length at least 3 times the length of each bottom edge and wherein each bottom edge is disposed at an angle of one hundred thirty-five degrees with respect to each of the respective first edges and each of the respective second edges.

13. A comfort positioning pillow in accordance with claim 12, wherein the pillow includes an inner core and an outer casing, wherein the inner core is disposed within the outer casing.

14. A comfort positioning pillow in accordance with claim 13, wherein the inner core is formed of polyurethane foam, and wherein the outer casing is formed of stretch terry cloth.

15. A comfort positioning pillow in accordance with claim 12, wherein the first side surface and the second side surface are the same shape.

16. A comfort positioning pillow in accordance with claim 15, wherein the first side surface and the second side surface have the same dimensions.

17. A comfort positioning pillow in accordance with claim 12, wherein the top edge of the first side surface is longer than the bottom edge of the first side surface, and wherein the top edge of the second side surface is longer than the bottom edge of the second side surface.

18. A method of using a comfort positioning pillow with an appendage, wherein the comfort positioning pillow includes a first side surface; a second side surface; a flat front surface disposed between the first and second side surfaces; a flat back surface disposed between the first and second side surfaces, wherein the flat back surface is positioned at an angle between ninety degrees and one hundred degrees relative to the flat front surface; a top surface disposed between the first and second side surfaces, wherein the top surface is convex-shaped; and a bottom surface disposed between the first and second side surfaces, and disposed between the flat front surface and the flat back surface, the method comprising:

placing the first side surface on a support surface; and allowing the appendage to contact the second side surface.

* * * * *